United States Patent [19]

Textoris et al.

[11] 4,229,917

[45] Oct. 28, 1980

[54] STRUT SUPPORT ASSEMBLY

[75] Inventors: Melvin A. Textoris, Struthers, Ohio; Thomas L. Holman, Sharpsville, Pa.

[73] Assignee: GF Business Equipment, Inc., Youngstown, Ohio

[21] Appl. No.: 18,577

[22] Filed: Mar. 7, 1979

[51] Int. Cl.[2] ..... E04H 1/00

[52] U.S. Cl. ..... 52/239; 248/188

[58] Field of Search ..... 52/239, 71; 160/351, 160/135; 248/188, 188.8, 188.9, 188.91, 188.2

[56] References Cited

U.S. PATENT DOCUMENTS

| | | | |
|---|---|---|---|
| 1,549,144 | 8/1925 | Messegee | 248/188.2 |
| 2,107,629 | 2/1938 | Dallas | 248/188.2 |
| 2,409,622 | 10/1946 | Gottfried | 248/188.9 |
| 3,213,580 | 10/1965 | Mark | 52/292 |
| 3,794,281 | 2/1974 | Munsey | 248/188 |
| 4,056,903 | 11/1977 | Guarnere | 160/351 X |
| 4,117,999 | 10/1978 | Gessler | 248/188.2 |

*Primary Examiner*—Price C. Faw, Jr.

*Assistant Examiner*—Carl D. Friedman

*Attorney, Agent, or Firm*—Emory L. Groff, Jr.

[57] ABSTRACT

A strut support assembly for a partition system includes a retainer assembly projecting from beneath an upright and provided with a fastener receiving groove intermediate an enlarged medial section of the retainer assembly and the bottom of the upright. A removable strut assembly includes an arcuate attachment surface mating with the configuration of the upright exterior and a plurality of vertically spaced-apart horizontal cut-outs through the arcuate surface for the selective insertion of a U-bolt therethrough to captively engage the fastener receiving groove and rigidly attach the strut assembly relative the upright. The groove is of sufficient vertical extent to accommodate a second U-bolt for securing an additional oppositely disposed strut assembly to the same upright and the retainer assembly medial section includes an upwardly facing circular recess serving to receive and retain attachment structure carried by one or more panels of the partition system.

12 Claims, 5 Drawing Figures

47
7
48
58
54
53
58
10
65
65
2b
62
70
C
8
3
2a
2
51
50
52
49
47
7
48
60
53
4
4
1
12
3
C
8
62
64
63
43
9
27
6
14
10
21
22
69
13
26
70
46
70
S
2
4
5
11

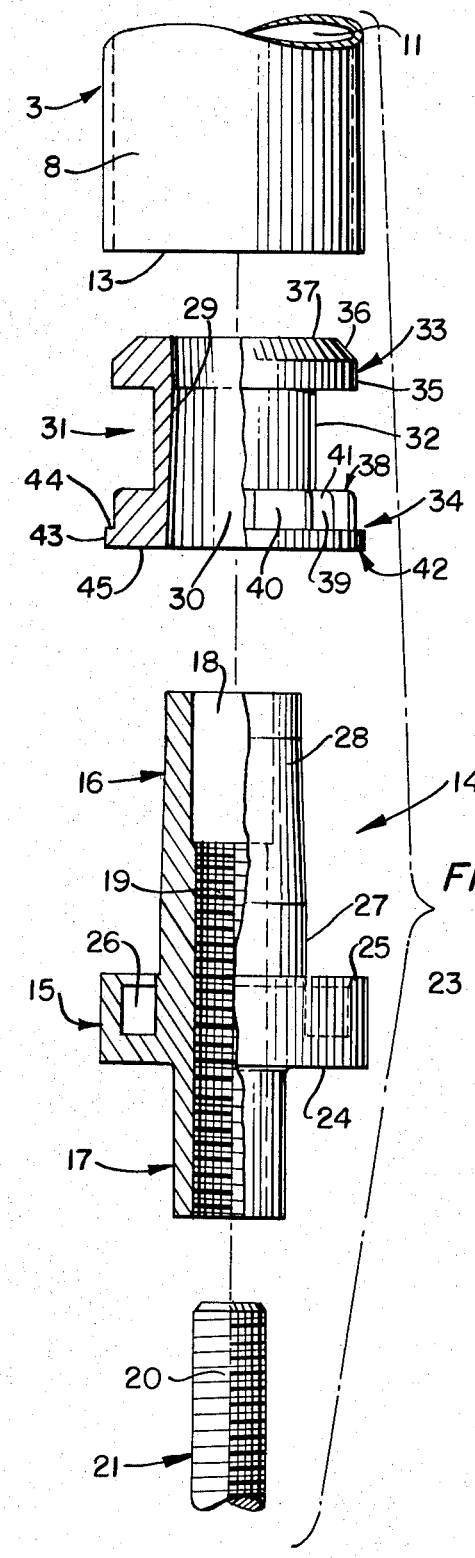
FIG. 3.
FIG. 4.
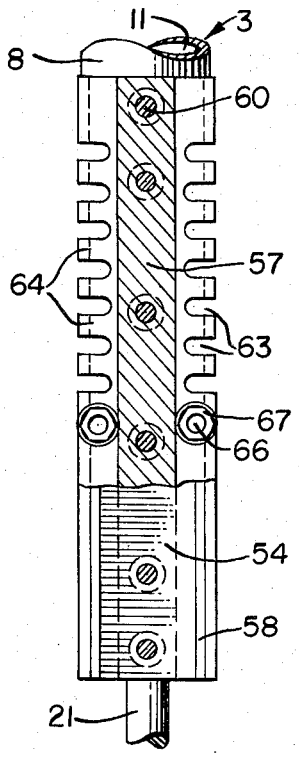
FIG. 5.
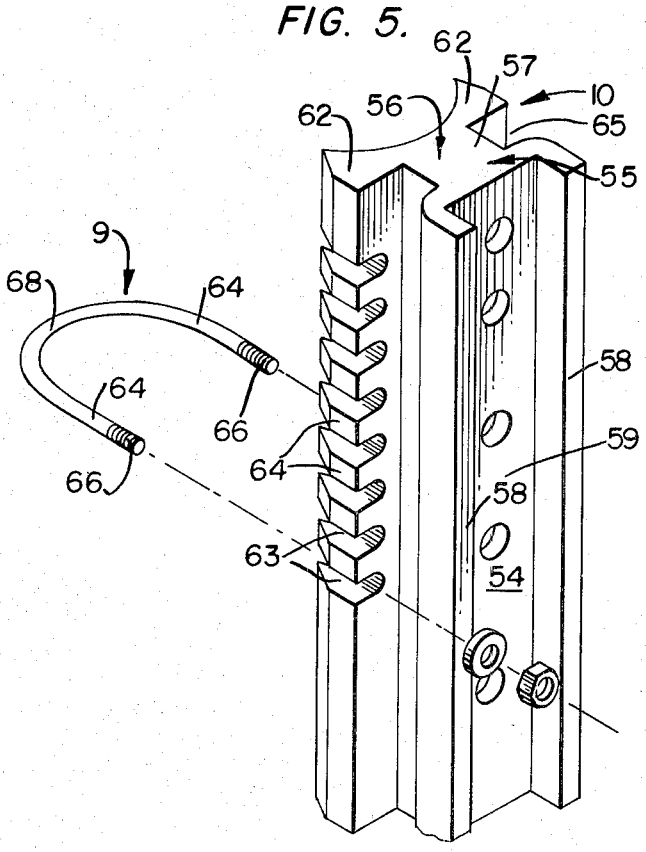

STRUT SUPPORT ASSEMBLY

This invention relates generally to office partition or panel systems and more particularly, to an improved leg or strut assembly readily attachable to an upright or post and engageable with the underlying floor to provide lateral stability to the partition assembly.

A popular arrangement in office buildings involves the utilization of the open space concept wherein individual offices or work areas are provided by installation of partition or panel systems comprising one or more panels disposed in either a straight line and/or in an angular configuration. Usually, these partitions extend upwardly little more than eye level and therefore must be supported and stabilized along only the bottom and end edges of the partition panels. Such an arrangement results in many free-standing terminal partitions and uprights necessitating the addition of adequate means to ensure lateral stability thereof.

Many prior attempts have been made to provide laterally extending support legs or struts for partition systems. In many of these instances, either a multitude of components have been required or on the other hand, it was often necessary to at least partially disassemble the structure prior to making any adjustment of the elevation of the strut or leg member. U.S. Pat. No. 3,674,230 issued to Propst on July 4, 1972 discloses an example of a substantially L-shaped support leg or strut comprising a plurality of components and wherein the strut member remains affixed relative the partition support post during adjustment of the latter and subsequent adjustment between the strut and the floor is achieved by manipulation of a screw-mounted glide at the end of the strut. U.S. Pat. No. 3,213,580 issued Oct. 26, 1965 to Mark illustrates a panel partition system with L-shaped stabilizing members affixed to the lower portion of a supporting post and which includes a housing or cover adapted to overlie the support leg. In this instance the cover merely masks the already attached and locked support leg and subsequent adjustment of the latter support cannot be made until the separate cover member is removed free and clear of the balance of the assembly.

In the present invention an improved strut support assembly is provided comprising a floor strut which may be readily attached to the periphery of the lower portion of any of the uprights or posts of a panel system by means of a single fastener element cooperating with a unique retainer assembly connected to and extending beneath the bottom of each of the uprights. The strut assembly includes a strut support provided with a plurality of vertically spaced-apart horizontal cut-outs allowing of the selective attachment of the fastener member to permit variable positioning of the elevation of the upright members and therefore the panels intended to be supported by the uprights. The same retainer assembly includes means for receiving and retaining the hook bracket or other mounting means carried by the ends of each of the partition panels for supporting the panels upon the uprights.

Thus, by the present invention it will be appreciated that a simple retainer assembly is provided which is initially inserted into the bottom open end of a post or upright and serves as means cooperating with a single fastener member for the subsequent ready attachment of a vertically adjustable strut assembly without the necessity of providing any modification of the upright. An attachment surface on the strut assembly is configured to provide continuous engagement with both the lower portion of the upright periphery as well as a peripheral wall of the retainer assembly and a rigid attachment of the floor strut is achieved without any mechanical function between either the upright or retainer assembly other than the releasable clamping engagement provided by the single releasable fastener member.

Accordingly, one of the objects of the present invention is to provide an improved strut support assembly for a partition system including an L-shaped strut having a strut support provided with an arm configured to overlie the periphery of an upright and including a plurality of spaced-apart cut-outs for the selective reception of a fastener member releasably engaging the strut support and a retainer assembly depending from the bottom of the upright.

Another object of the present invention is to provide improved strut support assembly for a partition system having a curved attachment surface vertically positionable juxtaposed a curved periphery of an upright and clampingly secured thereto by means of a releasable fastener cooperating with a retainer assembly extending from the bottom edge of the upright.

Still another object of the present invention is to provide an improved strut support assembly for a partition system including a retainer assembly extending from beneath an upright and provided with an encircling groove for the reception of a fastener carried by the strut assembly.

Another object of the present invention is to provide an improved strut support assembly for a partition system including an upright having a retainer assembly attached to its bottom edge and having a pair of press-fitted components one of which includes means capable of receiving a fastener carried by the strut assembly and also includes an upwardly facing groove for receiving attachment means carried by a removable panel.

A further object of the present invention is to provide an improved strut support assembly for a partition system including a retainer assembly comprising a pair of press-fitted components one of which is insertable within the interior of the bottom of a hollow upright and which is combined with a vertically adjustable glide assembly together with means for receiving an encircling fastener for the mounting of a strut assembly as well as means for receiving attachment means carried by a panel of the partition assembly.

With these and other objects in view which will more readily appear as the nature of the invention is better understood, the present invention consists of the novel construction, combination and arrangement of parts hereinafter more fully described, illustrated and claimed.

FIG. 3 is an enlarged exploded side elevation more clearly illustrating the components of the retainer assembly;

FIG. 4 is an end elevation, partly in section, of the strut support and,

FIG. 5 is a perspective view of the strut support of FIG. 4.

Similar reference characters designate corresponding parts throughout the several figures of the drawings.

Figures 1, 2:
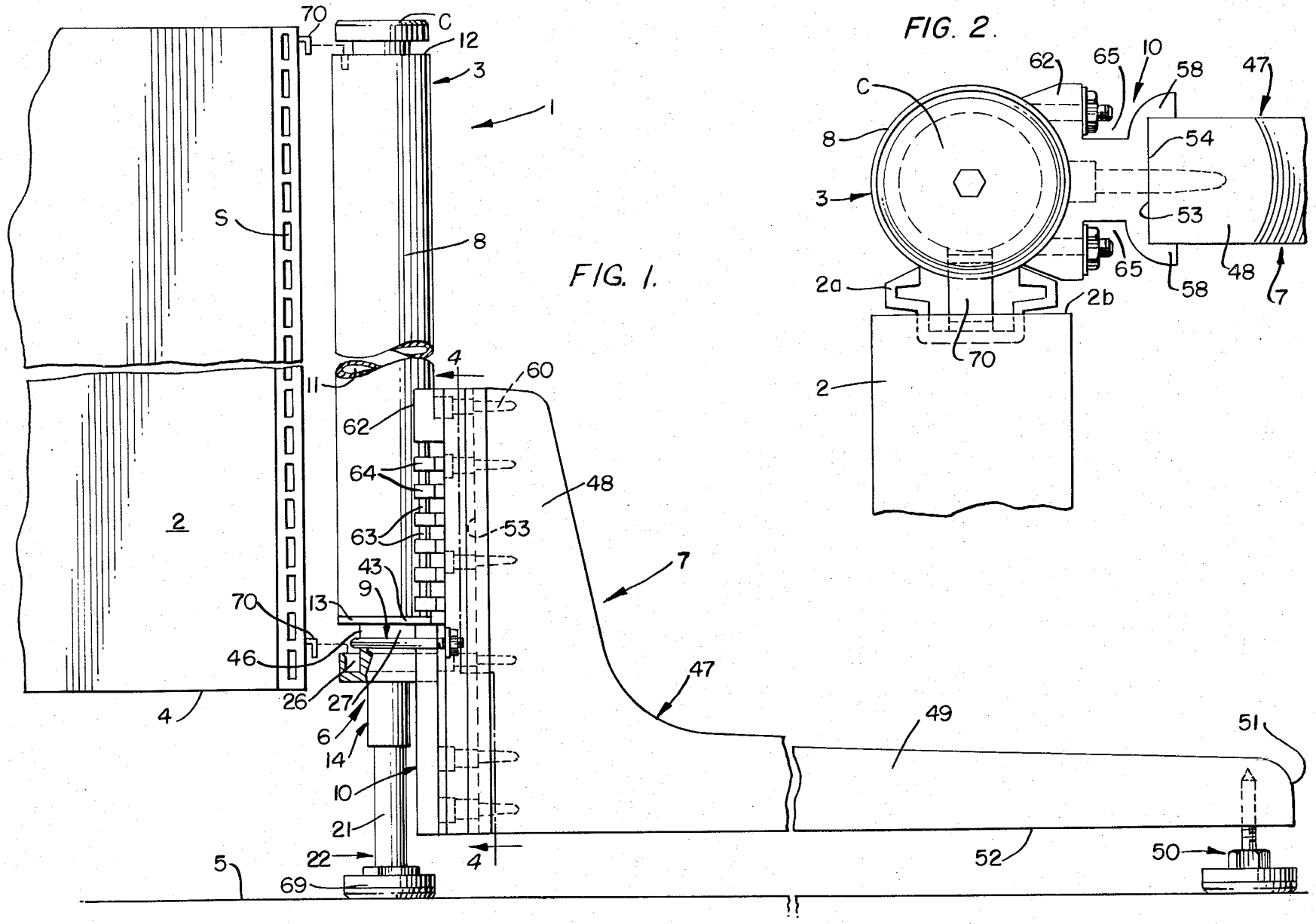
FIG. 1 is a side elevation, partly exploded, of the strut support assembly of the present invention.
FIG. 2 is a top plan view of the present invention illustrating the panel of FIG. 1 as it would appear when attached to the partition system upright.

Referring now to the drawings, particularly FIG. 1, the present invention will be seen to relate to a partition system, generally designated 1, including a panel 2 adapted to be vertically attached to the supporting post or upright 3. In such a partition system, the bottom edge 4 of each panel 2 is intended to be supported at a point substantially elevated from an underlying supporting surface or floor 5. The present invention includes unique means in the form of a retainer assembly 6 for not only facilitating the attachment of each panel 2 but also for providing mounting means for the strut assembly 7.

The present arrangement is particularly adaptable for partition systems utilizing round or cylindrical uprights 3 wherein the cylindrical exterior periphery 8 of the upright has often presented a problem in providing ready means for the attachment of a laterally extending strut mechanism. A previous solution was to provide a strut support member with a plurality of downwardly extending hook elements adapted to engage selective ones of mating slots S formed in the edge channel 2*a* carried by the ends 2*b* of the panel 2. Slotted edge channels may still be employed with the instant invention as shown in FIG. 1 for the optional use by the customer in attaching brackets for supporting shelves (not shown) but will be understood to form no critical art of the strut support assembly.

With the present invention the strut assembly 7 is positively and adjustably secured relative the partition system 1 without any dependence upon the structure associated with the panel 2, the attachment being made by means of a single encircling fastener member 9 carried by the strut support 10 of the strut assembly and engaging a cylindrical portion of the retainer assembly 6. The cylindrical upright 3 will be understood to include a hollow interior 11, at least adjacent the top edge 12 and bottom edge 13 and the retainer assembly 6, when once installed, becomes a rigid integral part of the upright 3.

The construction of the components comprising the retainer assembly 6 are most clearly shown in FIG. 3 of the drawings where it will be seen that this assembly comprises a lowermost retainer bottom member 14 comprising an enlarged cylindrical medial section 15 bounded by a smaller diameter upper section 16 and lower section 17. A central bore 18 extends throughout the retainer bottom member 14 and includes a threaded portion 20 of the shaft 21 forming a portion of the adjustable glide assembly 22. The enlarged medial section 15 of the retainer bottom member 14 includes a cylindrical peripheral wall 23 having a diameter equal to that of the exterior periphery 8 of the upright 3. The bottom wall 24 of the medial section 15 is preferably enclosed while the top wall 25 thereof will be seen to be provided with an upwardly facing cylindrical recess or groove 26 serving as the receiving and retaining means for appropriate attaching means carried by the panels 2 as will be described hereinafter.

The upper section 16 extending above the medial section 15 includes a smooth cylindrical portion 27 having a vertical extent which is no less than the thickness of two of the fastener members 9, a relationship which will become obvious hereinafter. Above the vertical cylindrical portion 27, the upper section 16 will be seen to be provided with an inwardly tapered portion 28 adapted to form a secure mating fit with the tapered interior 29 of the bore 30 of the adjacent retainer sleeve 31. This retainer sleeve includes a central cylindrical body 32 having a diameter less than that of the hollow interior 11 of the upright 3 and is bounded by the upper section 33 and lower section 34. The cylindrical periphery 35 on the upper section 33 is constructed to provide a tight sliding fit within the upright interior 11 and includes an uppermost chamber 26 designed to facilitate insertion of the top 37 of the retainer sleeve 31 through the bottom edge 13 of the upright. The lower section 34 on the other hand, will be seen to include a plurality of radial ribs 38 extending outwardly from the central body 32 and including vertically extending outer surfaces 39 constructed to provide a tight press-fit when driven into the interior 11 of the upright 3. The ribs 38 will be seen to be spaced from one another as at 40 and each outer surface 39 is joined to a curved upper surface 41 offering a camming action as the ribs 38 are driven past the upright bottom edge 13. The lower section 34 includes a cylindrical flange 42 beneath the ribs 38 having an outer periphery 43 formed with a diameter equal to that of the exterior 8 of the upright. A small shoulder 44 formed atop the flange 42 between the periphery 43 and the rib outer surface 39 will be seen to serve as a stop when the retainer assembly 6 is installed within the bottom of the upright 3 at which point the shoulder 44 abuts the upright bottom edge 13 as shown in FIG. 1 of the drawings.

When in the assembled position of FIG. 1, the retainer sleeve 31 is secured to the retainer bottom member 14 by means of the cooperating tapered interior 29 and tapered portion 28 respectively and when thus fully seated upon one another the flat bottom surface 45 of the retainer sleeve 31 is fixedly disposed at a point adjacent the uppermost limit of the vertical cylindrical portion 27 of the retainer bottom member 16. This disposition of the two components of the retainer assembly 6 will be seen to form a fastener receiving groove 46 below the bottom edge 13 of the upright and is of sufficient height to allow for the encircling body of two fastener members 9 of the type as shown in FIGS. 1 and 5 of the drawings.

As previously mentioned, the single fastener member 9 encircling the retainer assembly 6 within the groove 46 provides the sole means for rigidly retaining the strut assembly 7 in its use position. This strut assembly includes a floor strut 47 attached to the strut support 10. The floor strut 47 preferably comprises an L-shaped construction including a vertical or upright base section 48 joined to a radial or outwardly projecting leg section 49. An appropriate adjustable leveling mechanism 50 is carried by the leg section 49 adjacent its distal portion 51 and projects downwardly from the bottom edge 52 of the strut 47. The base section 48 includes a vertically disposed inner edge 53 adapted to be retained in abuting relationship with a platform 54 provided by the strut support 10.

As shown most clearly in FIGS. 1, 2 and 5 of the drawings, the strut support 10 includes a strut mounting section 55 joined to a post mounting section 56 by means of an intermediate web 57. The aforementioned platform 54 will be seen to be bounded by means of a pair of spaced-apart and outwardly directed flanges 58—58 forming the groove 59 therebetween and into which the strut inner edge 53 is adapted to be slidably disposed following which the floor strut 47 and strut support 10 are securely mated into the integral strut assembly 7 by means of a plurality of strut assembly fasteners 60.

The innermost portion of the post mounting section 56 of the strut support 10 is provided with an arcuate attachment surface 61 the radius of curvature of which is equal to that of the exterior periphery 8 of the upright 3 as well as the peripheral wall 23 of the retainer bottom member 14. The arcuate surface will be seen to be formed by a pair of lateral arms 62—62 extending the height of the strut support 10. A substantial portion of the upper extent of the strut support arms 62—62 is provided with a plurality of horizontally extending and laterally adjacent cut-outs of fastener carrying means 63 formed to provide a plurality of vertically spaced apart arm portions or segments 64. The vertical extent of each cut-out 63 will be understood to be slightly greater than the thickness of the body of the fastener member 9 and allows for the selective positioning of the legs 64 of the U-bolt fastener 9 through any two laterally adjacent cut-outs 63. As shown in FIG. 2 of the drawings, the web 57 of the strut support 10 is of substantially less transverse dimension than the adjacent mounting sections 55 and 56 such that a vertically extending recess 65—65 is formed on either side of the web. In this manner clearance is provided for the distal threaded portions 66 of the two parallel legs 64 of the U-bolt fastener member 9 and permits the subsequent attachment of appropriate threaded nuts 67 to tighten the medial curved portion 68 of the fastener member about the curved periphery 27 of the fastener receiving groove 46. When thusly tightened, the force applied as the fastener curved portion 68 is drawn toward the strut assembly support 10 will be understood to apply a clamping force between the arcuate attachment surface 61 of the strut support and both the periphery 8 of the upright 3 which is above the fastener 9, as well as against the periphery 23 of the retainer assembly 6, which is below the fastener member 9.

With the foregoing in mind it will be understood that positive attachment of the entire strut assembly 7 to the upright 3 and the retainer assembly 6 is achieved by selectively positioning the unitary fastener member 9 in any laterally adjacent pair of the vertically spaced-apart cut-outs 63—63 resulting in the fixedly supported elevation of the upright 3.

The primary load presented by any upright 3 and panels 2 attached thereto will be directed to the underlying support surface or floor 5 by means of the adjustable glide assembly 22 axially attached to the bottom of the upright 3. The aforedescribed threaded shaft 21 of the glide assembly 22 is rotated to properly position the shaft relative the threaded interior 19 of the retainer assembly 6 so as to properly position the glide 69 carried by the lower portion of the shaft 21 relative the floor 5. When the upright 3 is thus properly positioned for any particular partition system installation, it will be seen that it is a simple matter to select the appropriate pair of cut-outs 63 in the strut support 10 for properly achieving the correct elevation of the strut assembly 7 relative the remainder of the partition system 1. A final degree of stability is provided by the floor strut 47 by appropriate adjustment of the leveling mechanism 50 adjacent the distal portion 51 of the floor strut 47 whereby any irregularities in the configuration of the supporting surface 5 are compensated for and a firm footing is provided between the distal portion 51 of the floor strut and the supporting surface 5.

As previously mentioned, the upwardly directed circular groove 26 provided by the retainer assembly 6 is intended to serve as receiving means for appropriate attachment or mounting means carried by the panels 2. Accordingly, suitable means such as the hooks 70 are provided adjacent the top and bottom of each end edge **2*b* of the panel 2 as shown most clearly in FIG. 1 of the drawings. Each hook 70 preferably comprises a downwardly directed member carried by the panel edge channel 2*a* and the two members are intended to be simultaneously inserted into appropriate receiving means so as to support and maintain the end edge of the panel juxtaposed the periphery 8 of the upright 3. In the case of the lowermost one of the hooks 70, the depending leg thereof is inserted into the cylindrical groove 26 of the retainer assembly 6 concurrently with the insertion of the uppermost one of the hooks 70 into the top opening of the upright 3 following which, appropriate means such as the cap C is secured juxtaposed the top edge 12 of the upright in order to rigidly retain the top of the panel in its use position. Following the attachment of one or two panels to any single upright 3, one or two of the strut assemblies 7** are affixed as previously described.

The reason for forming the cylindrical portion 27 of the retainer assembly of sufficient height to produce a groove 46 capable of accepting two of the fastener members 9 will now be understood since this construction allows for the attachment of a pair of the strut assemblies to a single upright 3 as reflected by the additional fastener member shown in FIG. 1 in broken lines. In any case, when a strut assembly 7 is secured to an upright by means of the retainer assembly 6 it will be seen that the fastener member 9 overlies at least a portion of the top opening leading to the cylindrical groove 26 thereby retaining any lowermost hook elements 70 within the groove to preclude accidental separation of the bottom of the associated panel from the adjacent upright 3.

We claim:

1. A strut support assembly for a partition system including, an upright having an exterior periphery terminating in a bottom edge adjacent a hollow interior, a retainer assembly partly disposed within said upright interior and extending below said bottom edge, said retainer assembly having an enlarged medial portion and provided with a fastener receiving groove beneath said upright bottom edge and above said medial section, a strut assembly including a vertical strut support and a radially extending floor strut, said vertical strut support provided with an attachment surface having a configuration mating with that of said upright exterior periphery and said retainer assembly medial section, said strut support having fastener carrying means therein, a fastener member insertable through said fastener carrying means and encircling said retainer assembly within said fastener receiving groove to securely abut said strut assembly attachment surface against said upright periphery above said fastener member and against said retainer assembly medial section below said fastener member.

2. A strut support assembly according to claim 1 including, a glide assembly extending beneath said retainer assembly.

3. A strut support assembly according to claim 1 wherein, said upright periphery and the periphery of said retainer assembly medial section are circular.

4. A strut support assembly according to claim 3 wherein, said circular upright and medial section peripheries are of substantially equal diameter.

5. A strut support assembly according to claim 1 wherein, said attachment surface is curved.

6. A strut support assembly according to claim 1 wherein, said retainer assembly includes a retainer sleeve disposed atop a retainer bottom member, said sleeve provided with a central tapered bore, said bottom member having an upper section provided with a tapered distal portion insertable within said sleeve bore, and said fastener receiving groove is formed by said upper section beneath said tapered distal portion.

7. A strut support assembly according to claim 6 wherein, said retainer sleeve includes a plurality of ribs providing a press-fit within said upright interior.

8. A strut support assembly according to claim 6 wherein, said bottom member includes a central threaded bore, and a glide assembly provided with a threaded shaft disposed within said threaded bore.

9. A strut support assembly according to claim 1 wherein, said fastener member includes a U-bolt having a medial curved portion substantially conforming to the configuration of said fastener receiving groove.

10. A strut support assembly according to claim 1 wherein, said strut support fastener means includes a plurality of laterally adjacent pairs of vertically spaced-apart cut-outs whereby, said upright and retainer assembly may be variably vertically positioned relative said strut assembly prior to attachment therebetween by means of said fastener member disposed through a selected pair of said cut-outs.

11. A strut support assembly according to claim 1 wherein, said fastener receiving groove is of a vertical extent sufficient to accept two separate said fastener members each connected to a separate one of said strut assemblies.

12. A strut support assembly according to claim 1 including, one or more panels each having an end edge adapted to be disposed adjacent said upright periphery, said retainer means medial section provided with a circular upwardly directed recess beneath said fastener receiving groove, and a downwardly directed hook attachment member projecting from each said panel end edge and insertable within said recess.

* * * * *